US006237371B1

(12) United States Patent
Hsieh

(10) Patent No.: US 6,237,371 B1
(45) Date of Patent: May 29, 2001

(54) CIRCULAR KNITTING MACHINE CAM HOLDER MOUNTING STRUCTURE

(76) Inventor: Wen-Pien Hsieh, 5/F., No. 25, Hsingnan St., Nankang Dist., Taipei City (TW)

( * ) Notice: Subject to any disclaimer, the term of this patent is extended or adjusted under 35 U.S.C. 154(b) by 0 days.

(21) Appl. No.: 09/648,479

(22) Filed: Aug. 28, 2000

(51) Int. Cl.[7] ..... D04B 15/32
(52) U.S. Cl. ..... 66/57; 66/17
(58) Field of Search ..... 66/8, 13, 17, 38, 66/54, 57, 78, 19, 28

(56) References Cited

U.S. PATENT DOCUMENTS 3,614,877 * 10/1971 Radin ..... 66/57
3,848,432 * 11/1974 Mishcon et al. ..... 66/54
3,882,694 * 5/1975 Stepanek et al. ..... 66/54
3,926,013 * 12/1975 Kurth et al. ..... 66/40
4,080,805 * 3/1978 Ricart ..... 66/57

* cited by examiner

*Primary Examiner*—Danny Worrell
(74) *Attorney, Agent, or Firm*—Rosenberg, Klein & Lee

(57) ABSTRACT

A circular knitting machine cam holder mounting arrangement comprising a plurality of top cam holders, a plurality of bottom cam holders, a plurality of top cams, a plurality of bottom cams, and a plurality of track blocks, wherein: a plurality of second top cam holders and a plurality of second bottom cam holders are respectively fastened to peripheral flange of the top cam holders and the bottom cam holders, the second top cam holders and the second bottom cam holders each comprised of at least two holder parts abutted against one another, the holder parts of the second top cam holders and said second bottom cam holders each comprising a peripheral flange, a plurality of screw holes equally spaced on the peripheral flange, a plurality of screws respectively installed in the screw holes to secure the top cams and the bottom cams to the second top cam holders and the second bottom cam holders.

4 Claims, 11 Drawing Sheets

CIRCULAR KNITTING MACHINE CAM HOLDER MOUNTING STRUCTURE

BACKGROUND OF THE INVENTION

The present invention relates to a circular knitting machine, and more specifically to such a circular knitting machine, which enables the user to replace the top and bottom cam holders without detaching the yarn feeding unit and the knitting unit.

A regular circular knitting machine 1, as shown in FIG. 1A, is generally comprised of a yarn-feeding unit 13 at the top, a knitting unit 2 in the middle, and a fabric-receiving unit 12 at the bottom. The yarn-feeding unit 13 is supported on supports 14, comprising a suspension rack 141 adapted to hold the knitting unit 2. Please see also FIGS. from 12 through 15, a center shaft 32 is provided at the center of the suspension rack 141. A top needle plate holder 3 and a bottom needle plate holder 33 are respectively is mounted on the center shaft 32 at different elevations. The top needle plate holder 3 carries a top needle plate 31, which has horizontally radially extended needle grooves 311. The bottom needle plate holder 33 carries a bottom needle plate 3, which has vertically extended needle grooves 341 respectively aimed at the needle grooves 311 of the top needle plate 31. Top needles 312 and bottom needles 342 are respectively installed in the needle grooves 311 of the top needle plate 31 and the needle grooves 341 of the bottom needle plate 34. A motor 35 is installed in the suspension rack 141, and controlled to rotate the center shaft 32 through a transmission gear set 36, thereby causing the needle plate holders 3 and 33 and the needle plates 31 and 34 to be rotated with the center shaft 32. Please see also FIGS. from 15 through 19, a top cam holder 23 and a bottom cam holder 24 are respectively disposed corresponding to the top needle plate holder 3 and the bottom needle plate holder 33. Top cams 214 and bottom cams 224 are respectively fastened to respective screw holes 232 and 242 at the peripheral flanges 231 and 241 of the top cam holder 23 and the bottom cam holder 24. The top cams 214 and the bottom cams 224 each comprise a track block 2141 or 2241 defining a track 2142 or 2242 adapted to receive the butt 3121 or 3421 of the top needles 312 or bottom needles 342 respectively. When rotating the needle plates 31 and 34, the butts 3121 and 3421 of the needles 312 and 342 are respectively moved in the tracks 2141 and 2241, thereby causing the needles 312 and 342 respectively reciprocated. As indicated, the top cam holder 23 and the bottom cam holder 24 have a circular shape and screw holes 232 and 242 for the mounting of the cams 214 and 224. Normally, the number of the cams 214 and 224 can be 60, 72, 84 or 94. The number of the track blocks 2141 and 2241 is directly proportional to the number of the cams 214 and 224. The more the number of the cams 214 and 224 is, the faster the knitting speed will be. In order to fit different knitting speed requirements, different knitting machines with different numbers of cams shall be provided. For the sake of saving cost, there are provided knitting machines with replaceable cam holders. These knitting machines enable the user to replace different specifications of cam holders 23 and 24 to hold different numbers of cams 214 and 224. However, when replacing the cam holders 23 and 24, it is necessary to detach the yarn-feeding unit 13, the supports 14, and the knitting unit 2. Further, the mounting arrangement of the cams 214 and 224 according to the prior art is complicated. As illustrated in FIGS. 17 and 19, the cam holders 23 and 24 have screw holes 232 and 242 mounted with a respective locating rod 26. The cams 214 and 224 have slots 27 adapted to receive the locating rods 26 at the cam holders 23 and 24. Further, screws 2142 and 2243 are respectively obliquely installed to secure the cams 214 and 224 in place. This cam mounting arrangement has numerous drawbacks as outlined hereinafter.

1. The locating rods 26 are cylindrical members, they cannot let the central axis of the cams 214 and 224 be aimed at the same center accurately, thereby causing the cams 214 or 224 cannot be smoothly connected to one another (see FIG. 20). Unstable arrangement of the cams 214 and 224 affects the knitting quality.

2. The specifications of the cams 214 and 224 must be matched with the specifications of the cam holders 23 and 24, i.e., cam holders 23 and 24 of relatively bigger diameter must be used when the number of cams 214 and 22 are to be increased. Further, because the curvature of the alignment portions 28 of the cams 214 and 224 must fit the curvature of the alignment portion 29 of the cam holders 23 and 24, different specifications of cams 214 and 224 and different specifications of cam holders 23 and 24 must be prepared. Preparing a bit number of different specifications of cams 214 and 224 and different specifications of cam holders 23 and 24 require much storage space and investment.

SUMMARY OF THE INVENTION

The invention has been accomplished to provide a cam holder mounting arrangement for circular knitting machine, which eliminates the aforesaid drawbacks. It is one object of the present invention to provide a cam holder mounting arrangement for circular knitting machine, which enables the user to replace the top and bottom cam holders without detaching the yarn feeding unit and the knitting unit. It is another object of the present invention to provide a cam holder mounting arrangement for circular knitting machine, which keeps the top and bottom cams in accurate alignment with the center of the circular knitting machine. According to the present invention, second top cam holders and second bottom cam holders are provided to secure the top cams and bottom cams to the top cam holders and bottom cam holders, so that the top cam holders and bottom cam holders can conveniently be replaced when changing the numbers of top cams and bottom cams.

DETAILED DESCRIPTION OF THE PREFERRED EMBODIMENT

Figure 1A:
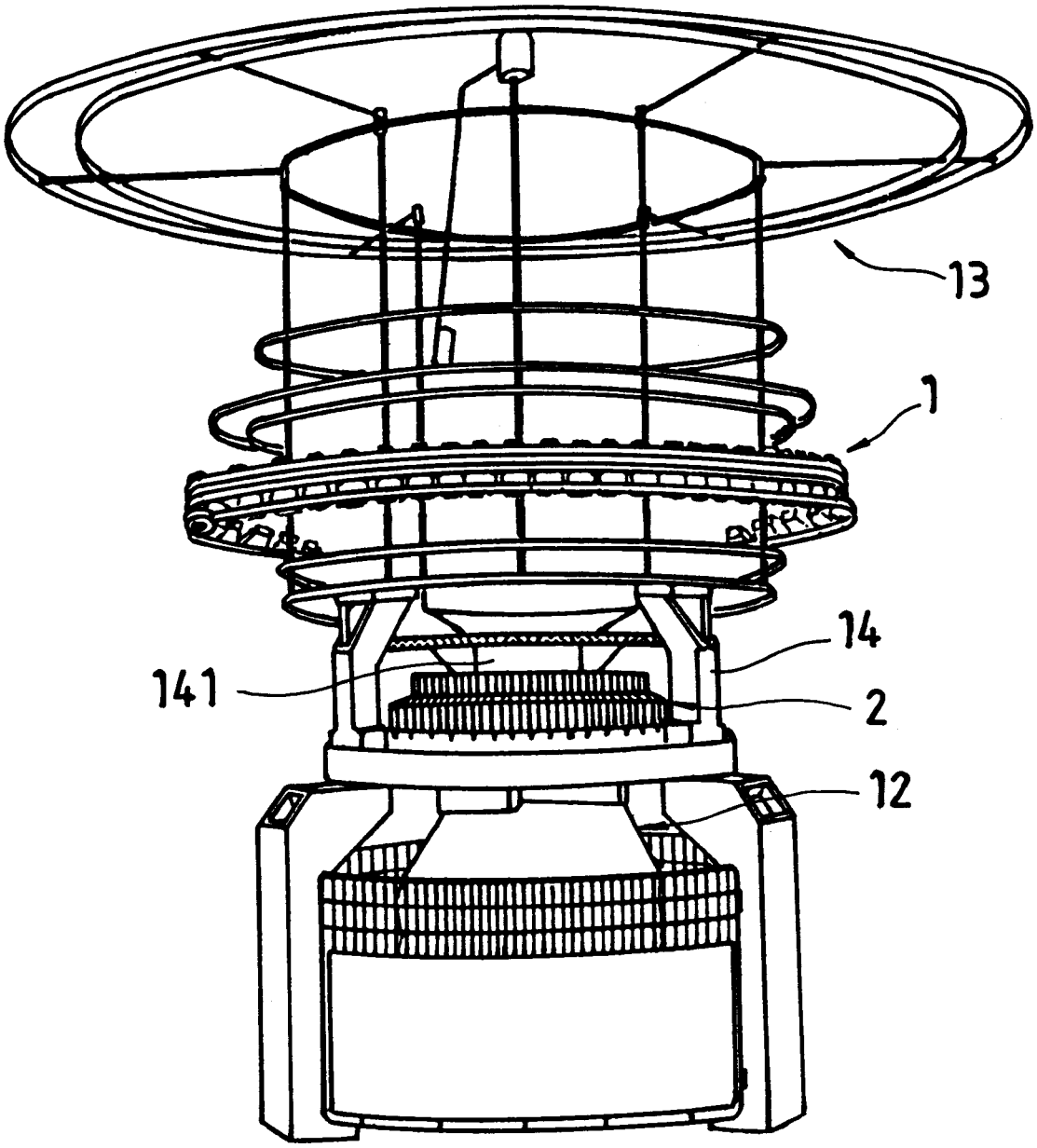
FIG. 1A is a perspective view of a regular circular knitting machine.
Figure 1B:
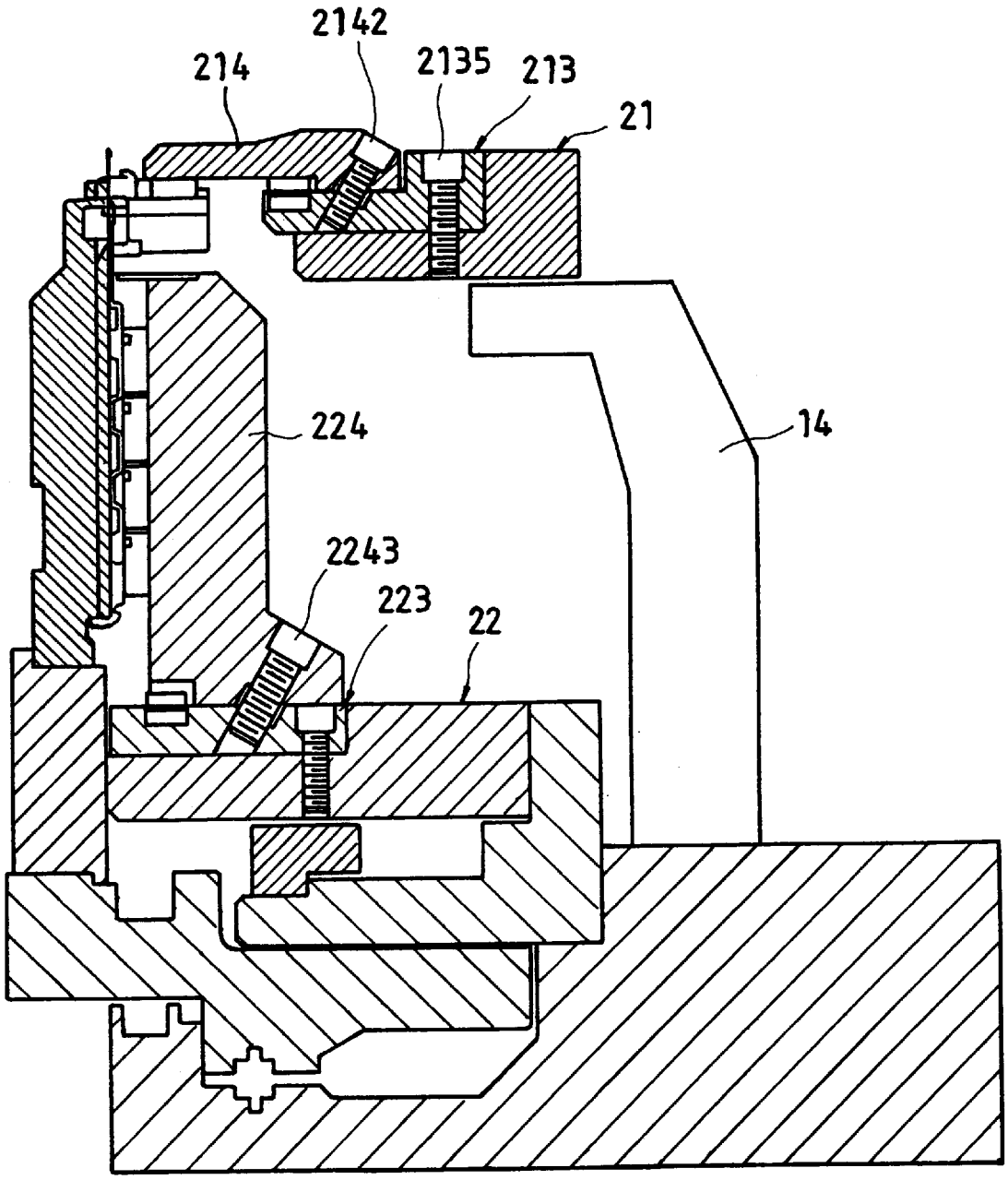
FIG. 1B is sectional view of a part of circular knitting machine constructed according to the present invention.
Figure 2:
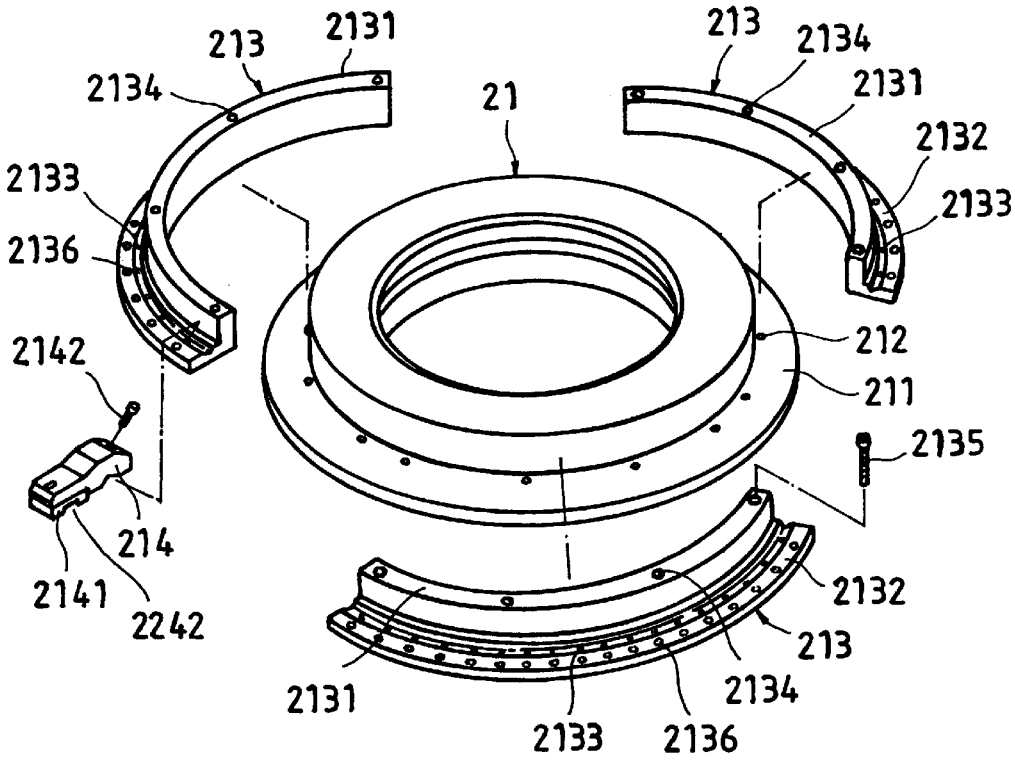
FIG. 2 is an exploded view of a top cam holder, a second top cam holder and a top cam according to the present invention.
Figure 7:
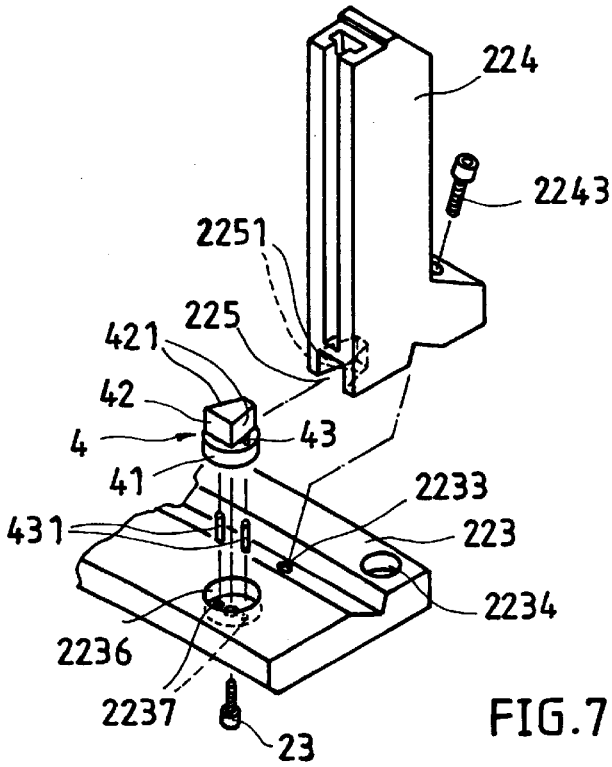
FIG. 7 is an exploded view of the bottom cam and the second bottom cam holder according to the present invention.
Figure 4:
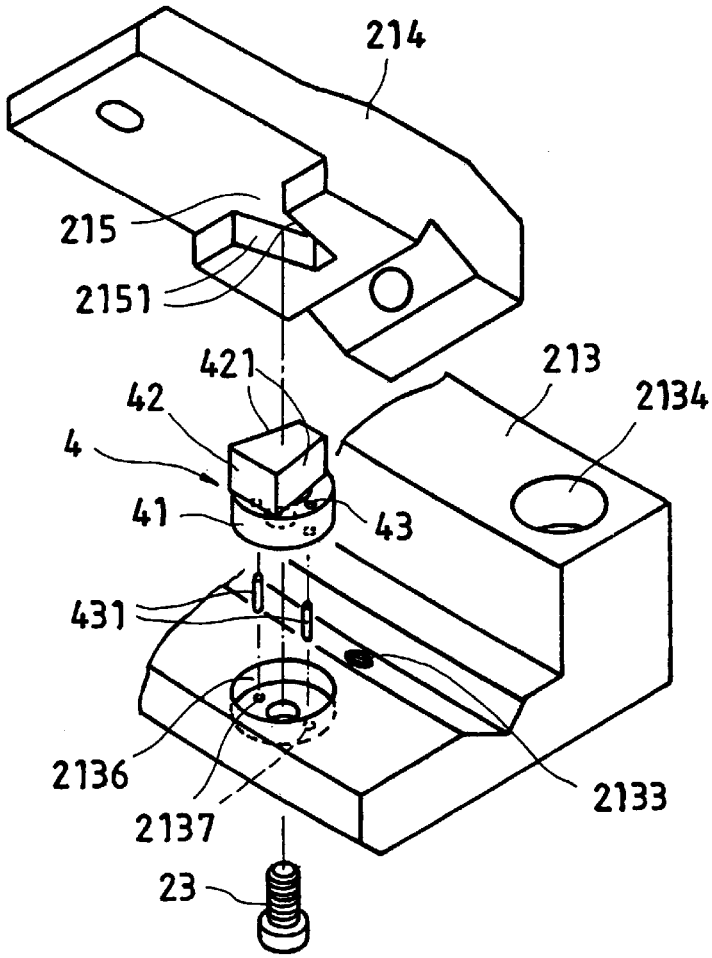
FIG. 4 is an exploded view of the top cam and the second cam holder according to the present invention.
Figure 3:
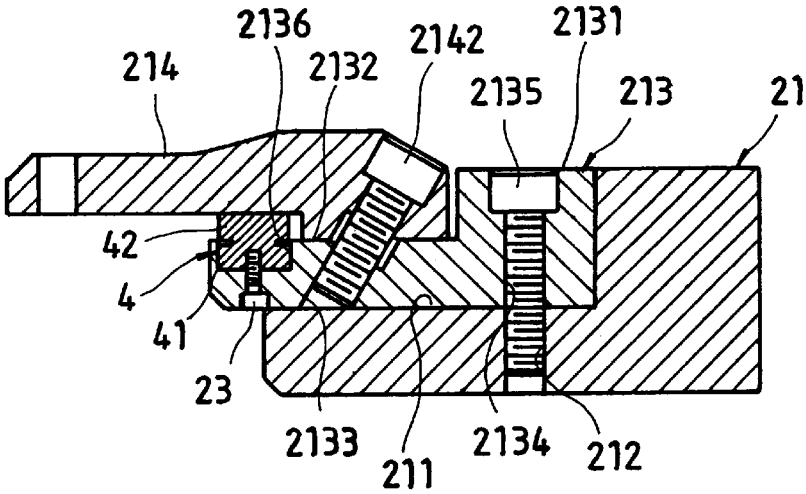
FIG. 3 is a sectional view showing the top cam holder and the second top cam holder and the top cam assembled according to the present invention.
Figure 5:
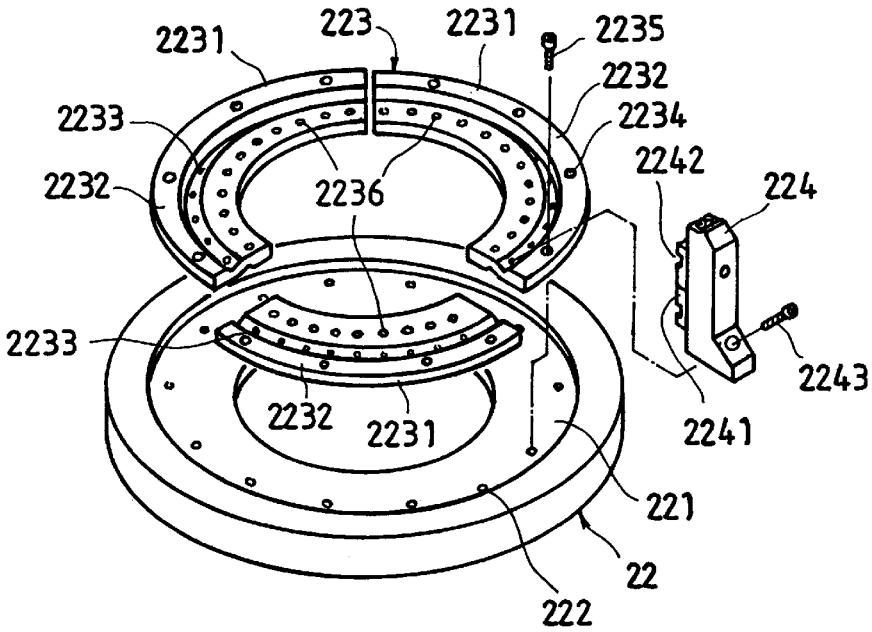
FIG. 5 is an exploded view of the bottom cam holder, the second bottom cam holder and the bottom cam according to the present invention.
Figure 8:
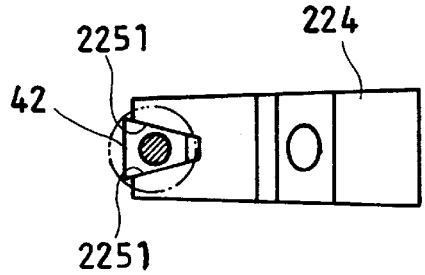
FIG. 8 is a sectional view showing the bottom cam and the cam-positioning device fastened together according to the present invention.
Figure 6:
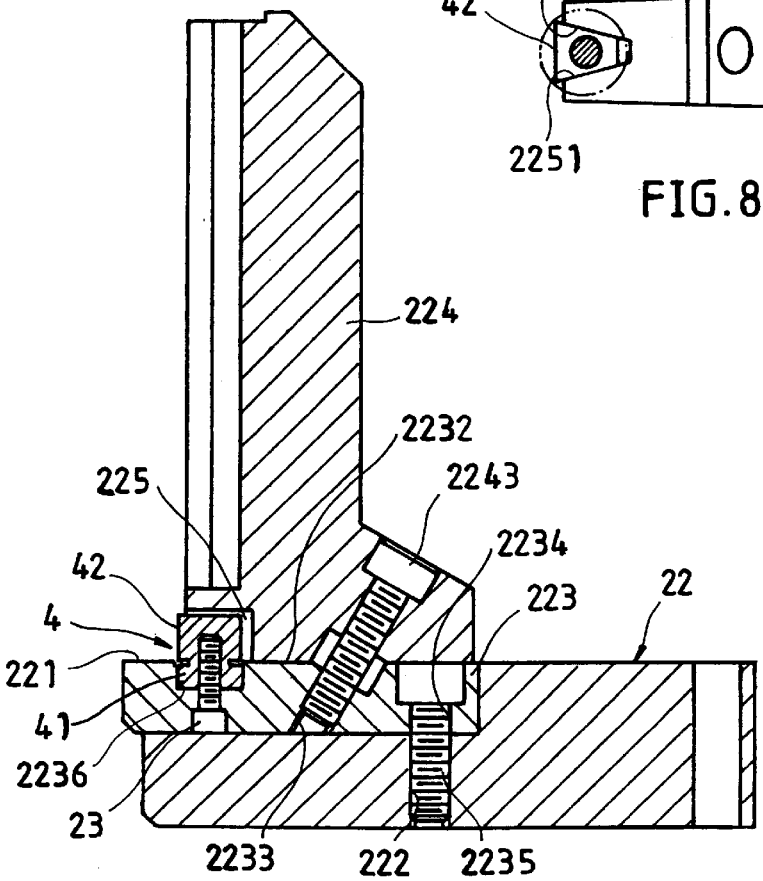
FIG. 6 is a sectional view showing the bottom cam holder, the second bottom cam holder and the bottom cam assembled according to the present invention.
Figure 9:
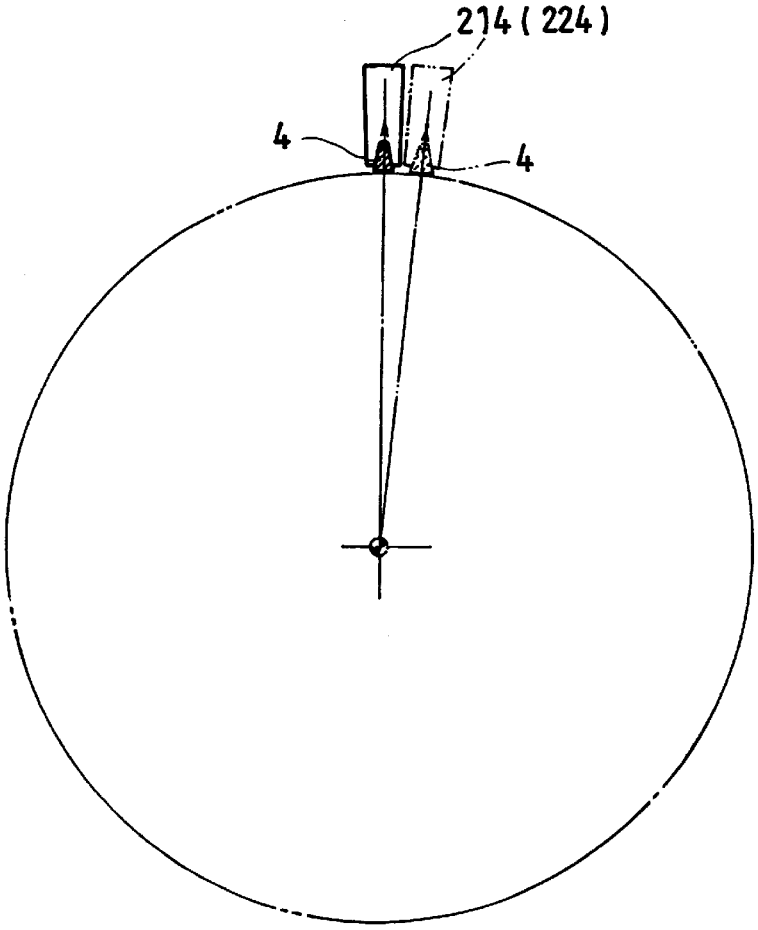
FIG. 9 is a schematic drawing showing the cams and the respective cam positioning devices aimed at the center of the circular knitting machine.
Figure 20:
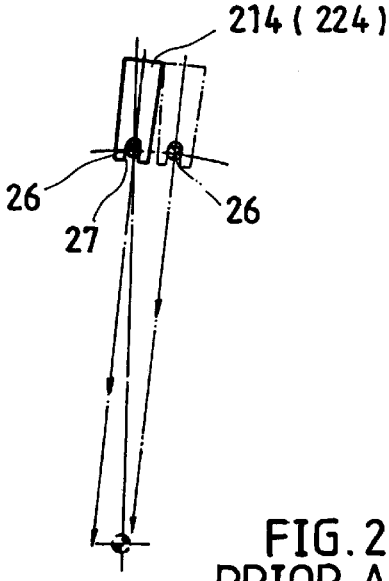
FIG. 20 PRIOR ART
FIG. 20 illustrates the direction of the positioning of the cam deviated according to the prior art.
Figure 10:
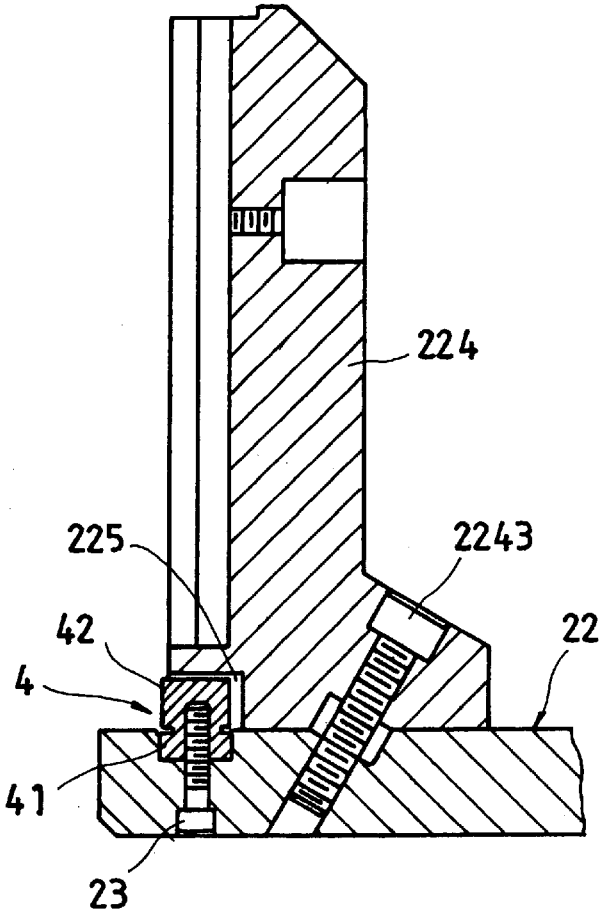
FIG. 10 is a sectional view showing the bottom cam directly fastened to the bottom can holder according to the present invention.
Figure 11:
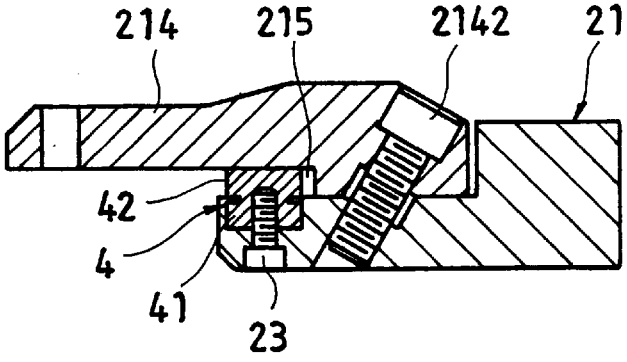
FIG. 11 is a sectional view showing the top cam directly fastened to the top cam holder according to the present invention.
Figure 12:
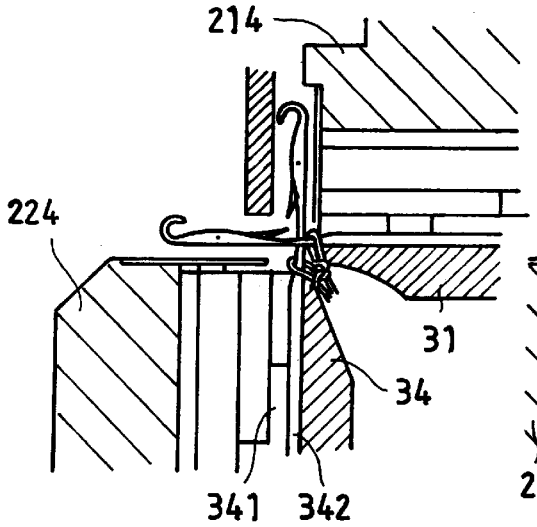
FIG.12 PRIOR ART
FIG. 12 is a sectional view showing the top needles and the bottom needles extended in the same direction according to the prior art.
Figure 13:
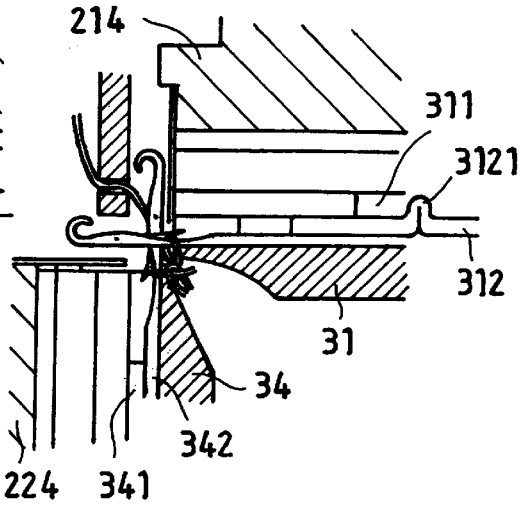
FIG.13 PRIOR ART
FIG. 13 is a sectional view showing the top needles and the bottom needles moved back in the same direction according to the prior art.
Figure 14:
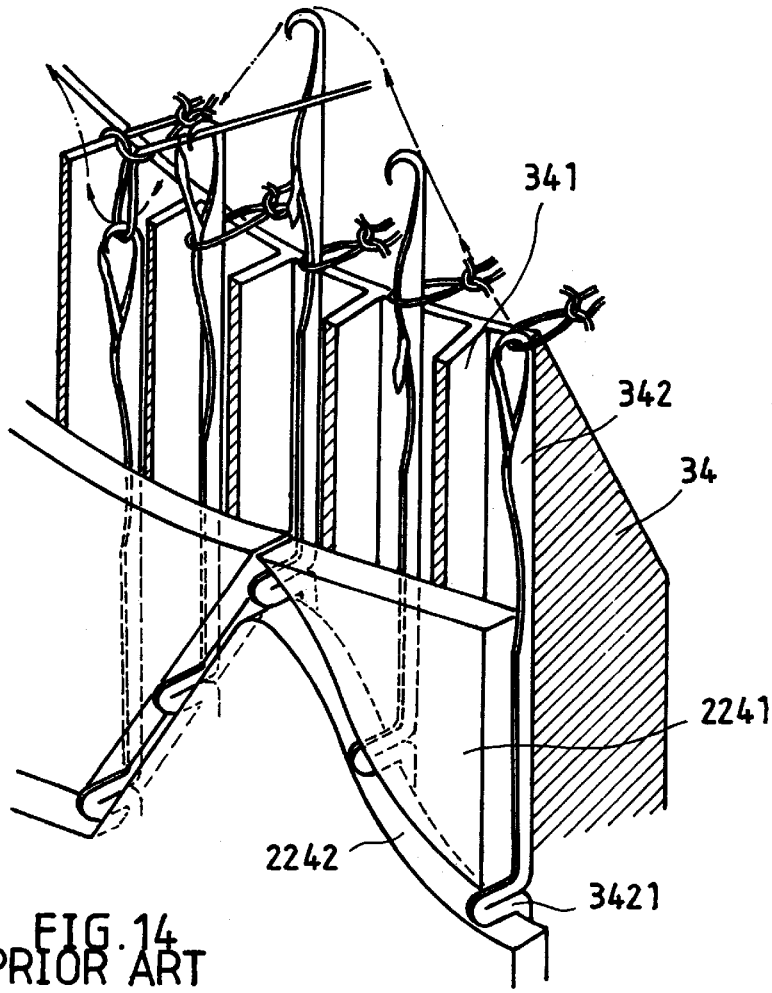
FIG.14 PRIOR ART
FIG. 14 illustrates the relationship between the bottom needles in the bottom needle plate and the track blocks according to the prior art.
Figure 15:
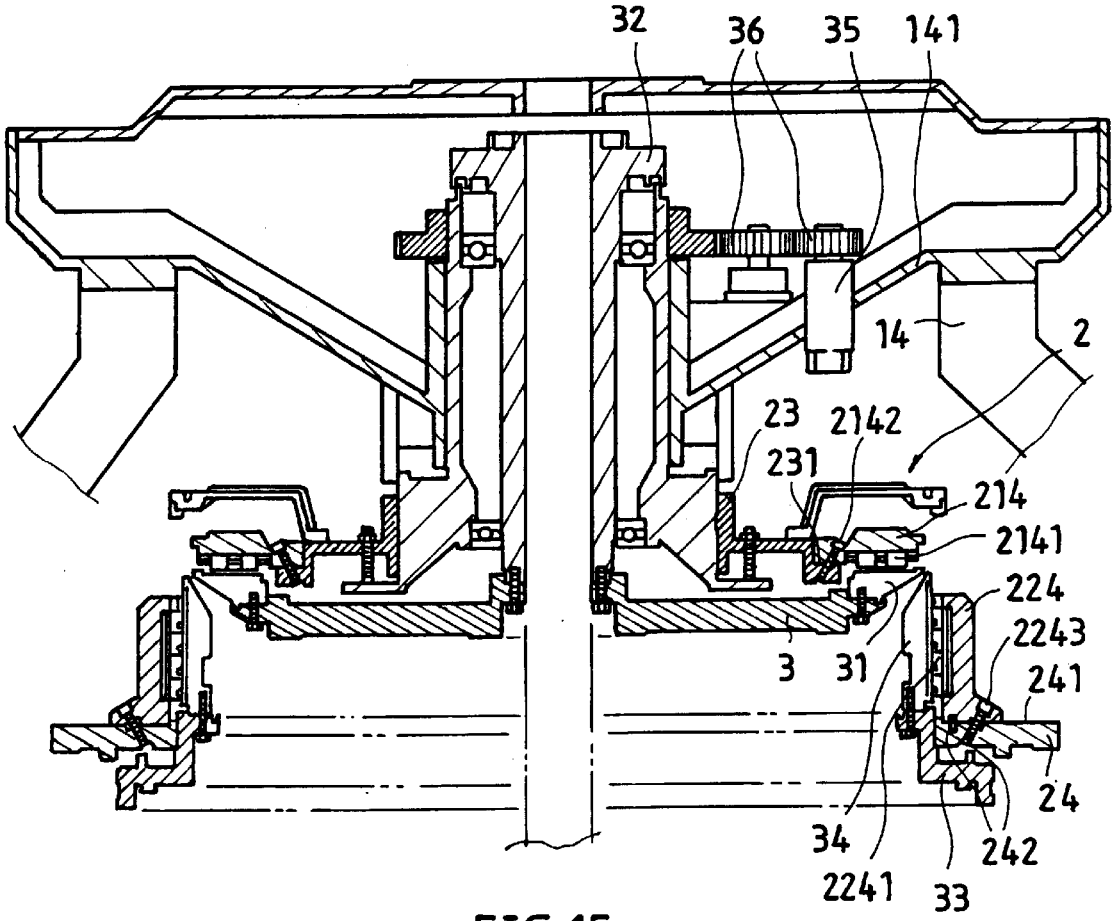
FIG.15 PRIOR ART
FIG. 15 is an assembly view of the suspension rack and the knitting unit according to the prior art.
Figure 16:
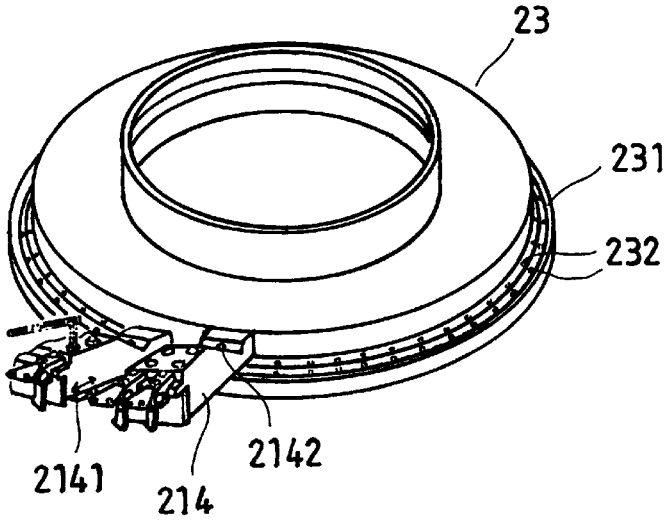
FIG.16 PRIOR ART
FIG. 16 is a perspective view of the top cam holder according to the prior art.
Figure 17:
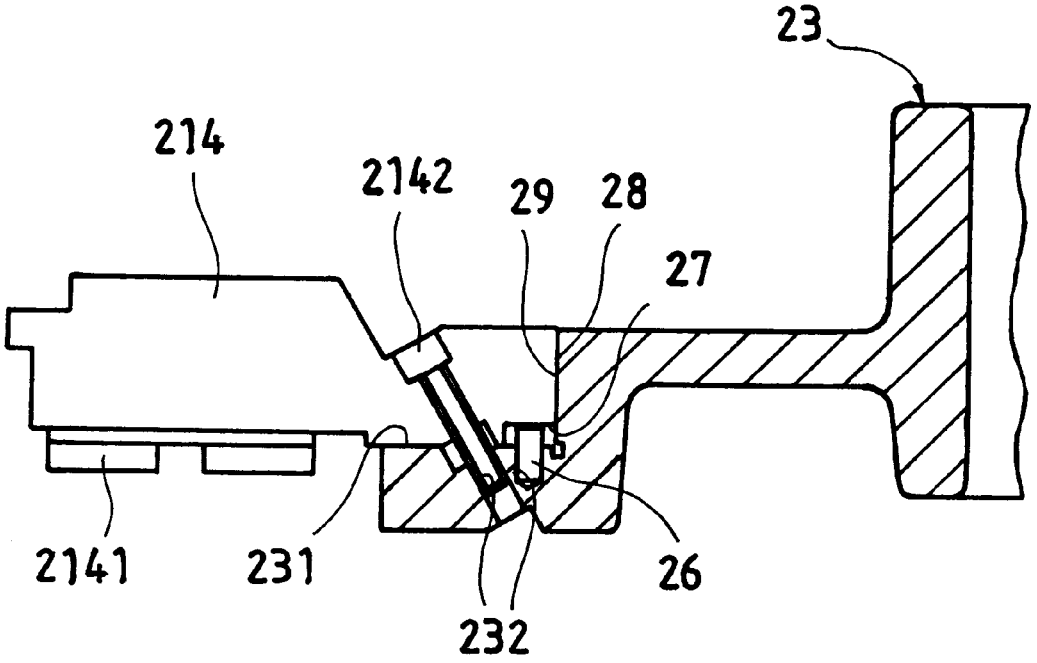
FIG.17 PRIOR ART
FIG. 17 is a sectional view showing the top cam holder and the top cam assembled according to the prior art.
Figure 18:
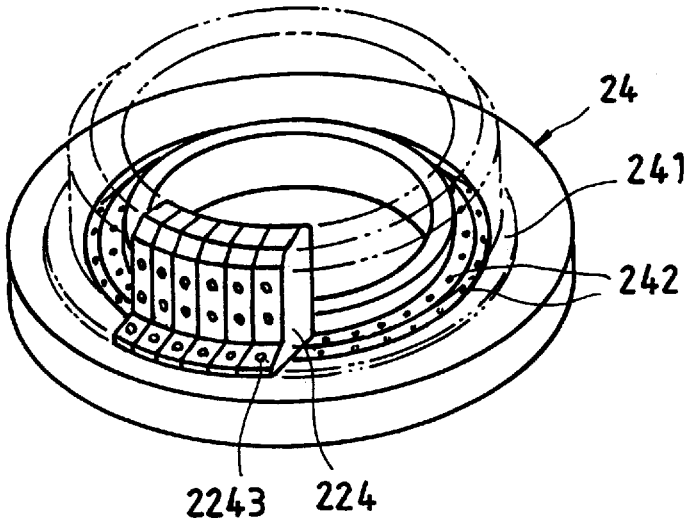
FIG.18 PRIOR ART
FIG. 18 is a perspective view of the bottom cam holder according to the prior art.
Figure 19:
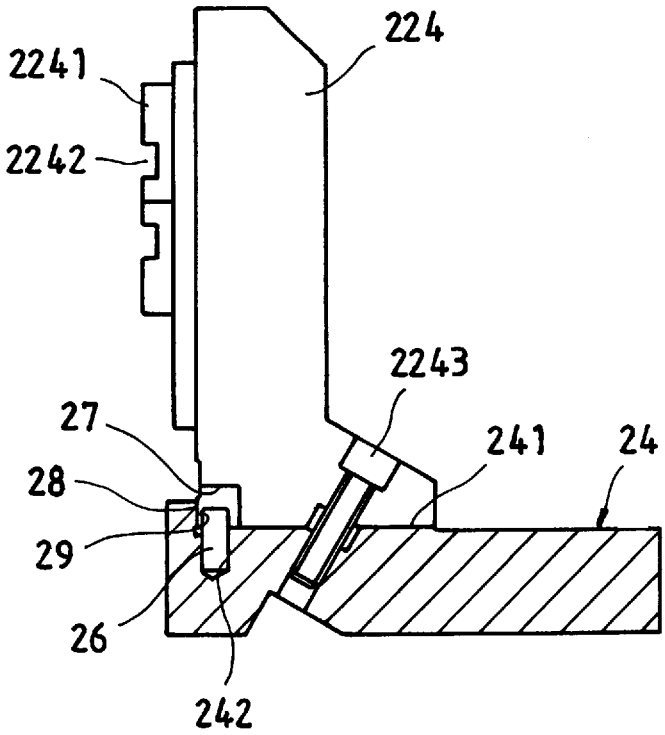
FIG.19 PRIOR ART
FIG. 19 is a sectional view showing the bottom cam holder and the bottom cam assembled.

Referring to FIGS. from 1 through 9, second top cam holders 213 and second bottom cam holders 223 are respectively fastened to the peripheral flanges 211 and 221 of the top cam holders 21 and the bottom cam holders 22. The second top cam holders 213 and the second bottom cam holders 223 each are comprised of at least two holder parts 2131 or 2231. Each holder part 2131 or 2231 comprises a peripheral flange 2132 or 2232, and a plurality of screw holes 2133 or 2233 equally spaced on the peripheral flange 2132 or 2232. Screws 2142 and 2243 are installed in the screw holes 2133 and 2233 to secure the respective top cams 214 and the respective bottom cams 224 to the second top cam holders 213 and the second bottom cam holders 223. Each holder part 2131 or 2231 further comprises a plurality of through holes 2134 or 2234. Screws 2135 and 2235 are inserted through the through holes 2134 and 2234 of the holder parts 2131 and 2231 and threaded into the screw holes 212 and 222 at the peripheral flanges 211 and 221 of the top cam holders 21 and the bottom cam holders 22 to secure the second top cam holders 213 and the second bottom cam holders 223 to the top cam holders 21 and the bottom cam holders 22 respectively. When changing the numbers of the top cams 214 and the bottom cams 224 or replacing the second top cam holders 213 and the second bottom cam holders 223, the second top cam holders 213 and the second bottom cam holders 223 can be directly detached for replacement. Because the top cam holders 213 and the bottom cam holders 223 each are comprised of at least two holder parts 2131 or 2231, the second top cam holders 213 and the second bottom cm holders 223 can easily be detached for replacement without dismounting the other parts of the circular knitting machine. The top cam holders 213 and the bottom cam holders 223 each have a plurality of positioning portions 2136 or 2236 for the mounting of cam positioning devices 4. Cam positioning devices 4 are respectively fastened to the positioning portions 2136 and 2236 of the top cam holders 213 and the bottom cam holders 223 by screws 23. Locating pins 431 are respectively inserted the mounting hole 43 on the base 41 of each cam positioning device 4 and the mounting holes 2137 and 2237 on the positioning portions 2136 and 2236 of the top cam holders 213 and the bottom cam holders 223 to positively and accurately secure the cam positioning devices 4 in position. Each cam-positioning device 4 comprises a pyramid-like top 42. The top 42 has two oblique sidewalls 421. The top cams 214 and the bottom cams 224 each have a notch 215 adapted to receive the top 42 of the corresponding cam positioning device 4. The notch 215 has two oblique sidewalls 2151 fitting the oblique sidewalls 421 of the top 42. Screws 2142 and 2243 are obliquely installed to fix the top cams 214 and the bottom cams 224 to the second top cam holders 213 and the second bottom cam holders 223 respectively. By means of the cam positioning devices 4, the top cams 214 and the bottom cams 224 can easily respectively be fastened to the top cam holders 21 and the bottom cam holders 22 (see FIGS. 10 and 11).

The aforesaid embodiment is used in a circular knitting machine 1 for knitting double-knitted fabrics. For a circular knitting machine for knitting single-knitted fabrics, the top cam holders 21 and the second top cam holders 213 are eliminated, and the second bottom cam holders 223 are respectively fastened to the bottom cam holders 22.

What the invention claimed is:

1. A circular knitting machine cam holder mounting arrangement comprising a plurality of top cam holders, a plurality of bottom cam holders, a plurality of top cams, a plurality of bottom cams, and a plurality of track blocks, wherein:

a plurality of second top cam holders and a plurality of second bottom cam holders are respectively fastened to peripheral flange of said top cam holders and said bottom cam holders, said second top cam holders and said second bottom cam holders each comprised of at least two holder parts abutted against one another, the holder parts of said second top cam holders and said second bottom cam holders each comprising a peripheral flange, a plurality of screw holes equally spaced on the peripheral flange, a plurality of screws respectively installed in the screw holes to secure said top cams and said bottom cams to said second top cam holders and said second bottom cam holders.

2. The circular knitting machine cam holder mounting arrangement of claim 1 wherein the holder parts of said second top cam holders and said second bottom cam holders each comprise a plurality of positioning portions, and a plurality of cam positioning devices respectively fastened to the positioning portions of said top cam holders and said bottom cam holders by screws, said cam positioning devices each comprising a base a mounting hole on said base, a locating pin installed in said mounting hole and a respective mounting hole on one positioning portion of said top cam holders or said bottom cam holders to positively and accurately secure the respective cam positioning device in position, a pyramid-like top coupled to one top cam or bottom cam, said top having two oblique side walls; said top cams and said bottom cams each comprise a notch adapted to receive the top of the corresponding cam positioning device, the notch of each of said top cams and said bottom cams having two oblique side walls fitting the oblique side walls of the top of said cam positioning devices.

3. A circular knitting machine cam holder mounting arrangement comprising a plurality of bottom cam holders, a plurality of bottom cams, and a plurality of track blocks, wherein:

a plurality of second bottom cam holders are respectively fastened to peripheral flange of said bottom cam holders, said second bottom cam holders each comprised of at least two holder parts abutted against one another, the holder parts of said second bottom cam holders each comprising a peripheral flange, a plurality of screw holes equally spaced on the peripheral flange, a plurality of screws respectively installed in the screw holes to secure said bottom cams to said second bottom cam holders.

4. The circular knitting machine cam holder mounting arrangement of claim 3 wherein the holder parts of said second bottom cam holders each comprise a plurality of positioning portions, and a plurality of cam positioning devices respectively fastened to the positioning portions of said bottom cam holders by screws, said cam positioning devices each comprising a base, a mounting hole on said base, a locating pin installed in said mounting hole and a respective mounting hole on one positioning portion of said bottom cam holders to positively and accurately secure the respective cam positioning device in position, a pyramid-like top coupled to one bottom cam, said top having two oblique side walls, said bottom cams each comprise a notch adapted to receive the top of the corresponding cam positioning device, the notch of each of said bottom cams having two oblique side walls fitting the oblique side walls of the top of said cam positioning devices.

* * * * *